US009815315B2

(12) United States Patent
Whaley

(10) Patent No.: US 9,815,315 B2
(45) Date of Patent: Nov. 14, 2017

(54) LOCKING RING METAL

(71) Applicant: U.S. Ring Binder LP, St. Louis, MO (US)

(72) Inventor: Paul Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 129 days.

(21) Appl. No.: 13/827,559

(22) Filed: Mar. 14, 2013

(65) Prior Publication Data

US 2014/0140754 A1 May 22, 2014

Related U.S. Application Data

(60) Provisional application No. 61/727,944, filed on Nov. 19, 2012.

(51) Int. Cl.

| | |
|---|---|
| ***B42F 3/02*** | (2006.01) |
| ***B42F 13/02*** | (2006.01) |
| ***B42F 13/00*** | (2006.01) |
| ***B42F 3/04*** | (2006.01) |
| ***B42F 13/16*** | (2006.01) |
| ***B42F 13/20*** | (2006.01) |
| ***B42F 13/26*** | (2006.01) |
| ***B42F 13/36*** | (2006.01) |

(52) U.S. Cl.

CPC ..... *B42F 13/26* (2013.01); *B42F 13/36* (2013.01)

(58) Field of Classification Search

CPC .... B42F 3/00; B42F 13/40; B42F 3/02; B42F 13/02; B42F 13/00; B42F 3/04; B42F 13/20; B42F 13/26; B42F 13/36

USPC .... 402/5, 19, 20, 26, 31, 35, 36, 37, 38, 39, 402/41

See application file for complete search history.

(56) References Cited

U.S. PATENT DOCUMENTS

| | | | | |
|---|---|---|---|---|
| 3,097,652 | A * | 7/1963 | Villhard | B42F 13/00 402/47 |
| 5,180,247 | A | 1/1993 | Yu | |
| 5,354,142 | A | 10/1994 | Yu | |
| 5,476,335 | A | 12/1995 | Whaley | |
| 5,611,633 | A | 3/1997 | Whaley | |
| 5,816,729 | A | 10/1998 | Whaley | |
| 5,924,811 | A | 7/1999 | To et al. | |

(Continued)

FOREIGN PATENT DOCUMENTS

| | | | |
|---|---|---|---|
| CA | 2493203 | A1 | 9/2005 |
| CN | 1709711 | A | 12/2005 |

(Continued)

*Primary Examiner* — Justin V Lewis
(74) *Attorney, Agent, or Firm* — Polster Lieder

(57) ABSTRACT

A locking ring metal includes binder rings each formed by a pair of complementary shaped binder ring halves. The binder rings are of a gap free construction. Each ring half has an end attached a frame. The frames are movable relative to each other to open and close the binder rings and are installed in a housing at one end of which a trigger is mounted. A travel bar installed within the housing above the frames and not connected to the trigger includes blocking elements which fit into respective brackets formed on the underside of the frames when the binder rings are closed to lock the binder rings in their closed position. A coil spring attached to the travel bar and the housing biases the travel bar in the direction to open the binder rings.

20 Claims, 10 Drawing Sheets

(56) References Cited

U.S. PATENT DOCUMENTS 5,957,611 A 9/1999 Whaley
6,062,760 A 5/2000 Whaley
6,270,279 B1 8/2001 Whaley
6,749,357 B2 6/2004 Cheng
6,840,695 B2 1/2005 Horn
6,916,134 B2 7/2005 Wong
6,974,273 B2 12/2005 Cheng
7,404,685 B2 7/2008 Cheng
7,513,708 B2 4/2009 Cheng et al.
7,524,128 B2 4/2009 Cheng
7,534,064 B2 5/2009 Cheng
7,549,817 B2 6/2009 Cheng et al.
7,597,498 B2 10/2009 Cheng
7,600,939 B2 10/2009 Liu et al.
7,648,302 B2 1/2010 Zhang et al.
7,654,764 B2 2/2010 To
7,661,898 B2 2/2010 Ng et al.
7,661,899 B2 2/2010 Lin
7,665,926 B2 2/2010 Cheng
7,674,062 B2 3/2010 Horn
7,726,897 B2 6/2010 To et al.
7,731,441 B2 6/2010 Ng et al.
7,744,300 B2 6/2010 Cheng et al.
7,748,922 B2 7/2010 Cheng
7,758,271 B2 7/2010 Cheng
7,762,734 B2 7/2010 Cheng
7,878,729 B2 2/2011 Cheng
7,891,901 B2 2/2011 Cheng et al.
7,950,867 B2 5/2011 Lin
8,002,488 B2 8/2011 Cheng
8,038,361 B2 10/2011 Cheng et al.
8,043,018 B2 10/2011 Cheng
8,047,737 B2 11/2011 Pi et al.
8,052,343 B2 11/2011 Zhang et al.
8,162,556 B2 4/2012 Cheng et al.
8,186,889 B2 5/2012 Ng et al.
8,393,819 B2 3/2013 Warmus
2003/0103796 A1 6/2003 To et al.
2003/0103798 A1 6/2003 Cheng et al.
2005/0207826 A1 9/2005 Cheng et al.
2005/0271459 A1 12/2005 To et al.
2006/0008318 A1 1/2006 Ng
2006/0024124 A1* 2/2006 Cheng ..... B42F 13/22 402/70
2006/0153630 A1 7/2006 Cheng
2007/0048071 A1 3/2007 Li et al.
2007/0048072 A1 3/2007 To et al.
2007/0048077 A1 3/2007 Cheng et al.
2007/0048078 A1 3/2007 Cheng
2007/0048079 A1 3/2007 Ng
2007/0048080 A1 3/2007 Cheng
2007/0086836 A1 4/2007 Cheng
2007/0134053 A1* 6/2007 Haneda et al. ..... 402/31
2007/0134054 A1* 6/2007 Li ..... 402/36
2007/0140778 A1 6/2007 Lin
2007/0140779 A1 6/2007 Cheng
2007/0140780 A1* 6/2007 Petrie ..... B42F 13/26 402/41
2007/0160415 A1 7/2007 To et al.
2007/0160416 A1 7/2007 Cheng
2007/0223990 A1 9/2007 Li et al.
2007/0283542 A1 12/2007 Cheng
2008/0050171 A1 2/2008 Cheng et al.
2008/0075526 A1 3/2008 Ng et al.
2008/0075527 A1 3/2008 Pi et al.
2008/0080925 A1 4/2008 Cheng
2008/0080926 A1 4/2008 Liu et al.
2008/0085145 A1 4/2008 To et al.
2008/0124166 A1 5/2008 Zhang et al.
2008/0170905 A1 7/2008 Cheng
2008/0175651 A1 7/2008 Cheng
2008/0175652 A1 7/2008 Cheng et al.
2008/0267691 A1 10/2008 Cheng
2008/0286035 A1 11/2008 To
2008/0298883 A1 12/2008 Cheng
2009/0035053 A1 2/2009 Pi et al.
2009/0041532 A1 2/2009 Cheng et al.
2009/0060631 A1 3/2009 To et al.
2009/0116896 A1 5/2009 To
2009/0169287 A1 7/2009 Cheng
2009/0274508 A1 11/2009 Zhang et al.
2009/0274509 A1 11/2009 Liu et al.
2009/0285623 A1 11/2009 Whaley
2010/0003070 A1 1/2010 Cheng
2010/0054850 A1 3/2010 Lin
2010/0166490 A1 7/2010 Cheng et al.
2010/0166491 A1 7/2010 Lin
2010/0232867 A1 9/2010 Ng et al.
2010/0278583 A1 11/2010 Cheng
2011/0085846 A1 4/2011 Cheng et al.
2011/0110703 A1* 5/2011 Cheng ..... B42F 13/26 402/38
2011/0170942 A1* 7/2011 Huang ..... B42F 13/26 402/31
2011/0305500 A1 12/2011 To
2011/0311300 A1 12/2011 To
2011/0311301 A1 12/2011 To
2011/0311302 A1 12/2011 To
2012/0051830 A1 3/2012 P: et al.
2012/0230755 A1 9/2012 Ng et al.
2013/0061447 A1 3/2013 Pigg, Jr. et al.

FOREIGN PATENT DOCUMENTS

CN 1727206 A 2/2006
CN 1978214 A 6/2007

* cited by examiner

LOCKING RING METAL

CROSS REFERENCE TO RELATED APPLICATIONS

The present application is related to and claims priority from U.S. provisional patent application 61/727,944 filed Nov. 19, 2012 which is herein incorporated by reference.

STATEMENT REGARDING FEDERALLY SPONSORED RESEARCH OR DEVELOPMENT

N/A

BACKGROUND OF THE INVENTION

This invention relates to locking ring metals for use in loose leaf ring binders; and, more particularly, to an improved locking ring metal.

As is well-known in the art, the purpose of a binder ring metal used to hold material, typically hole-punched sheets of paper or the like, so the material is readily available to a user and easily transported from one place to another. For this purpose, a ring metal has one or more binder rings with each ring comprising a pair of complementary shaped ring halves the outer ends of which are movable out of and into contact with each other. The holes in the paper or other material are inserted onto one of the ring halves when the binder is open, held in place when the binder is closed, and removed when the binder is again opened.

A problem with conventional ring binders is that if they are dropped or otherwise mishandled, the rings of the metal can inadvertently open allowing the contents of the binder to spill out. One approach to preventing this from happening has been to somehow lock the rings in their closed position so even if the binder is jarred, the rings remain closed and the contents secure. Various metal constructions have been developed to achieve locking of the binder rings.

One approach to solving the problem is described in U.S. Pat. Nos. 6,840,695 and 7,674,062, both to Horn, and the Horn published U.S. patent application 2006/0056906. Other recently issued patents which attempt to address the problem include U.S. Pat. No. 7,530,755 which is assigned to the same assignee as the present application, and U.S. Pat. No. 8,186,899 and published U.S. patent application 2012/0230755 both of which are assigned to World Wide Stationery Mfg. Co. Ltd.

In U.S. provisional patent application 61/727,944, filed Nov. 19, 2012 in the name of the same inventor as the current application, there is described an improvement to current locking ring metal designs. The present invention provides another improvement to these designs.

BRIEF SUMMARY OF THE INVENTION

The present invention is directed to a locking ring metal used in a loose leaf ring binder. The ring metal includes one or more binder rings each of which is formed by a pair of complementary shaped binder ring halves. One end of each ring half is attached to a frame and the frames are movable relative to each other within a housing in which they are installed thus to move the other ends of the associated ring halves out of and into contact with each other so to open and close the binder metal. A trigger is mounted on one end of the housing and its movement produces movement of the frames to open and close the binder ring(s).

A travel bar is installed in the housing, above the frames, but it is not connected to the trigger. This simplifies construction and assembly of the ring metal and reduces assembly costs. The travel bar has at least one blocking element which, when the binder metal is closed, blocks movement of the frames to effectively lock the binder rings in their closed position and prevent the ring metal from being inadvertently or accidentally opened.

Another improvement to the ring metal of the present invention is a spring which urges the travel bar in the direction to open rather than close the binder rings. This is contrary to other prior ring metal constructions, but this improvement simplifies operation of the ring metal.

A further improvement to the ring metal is a "gap free" binder ring construction.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

Figure 1A:
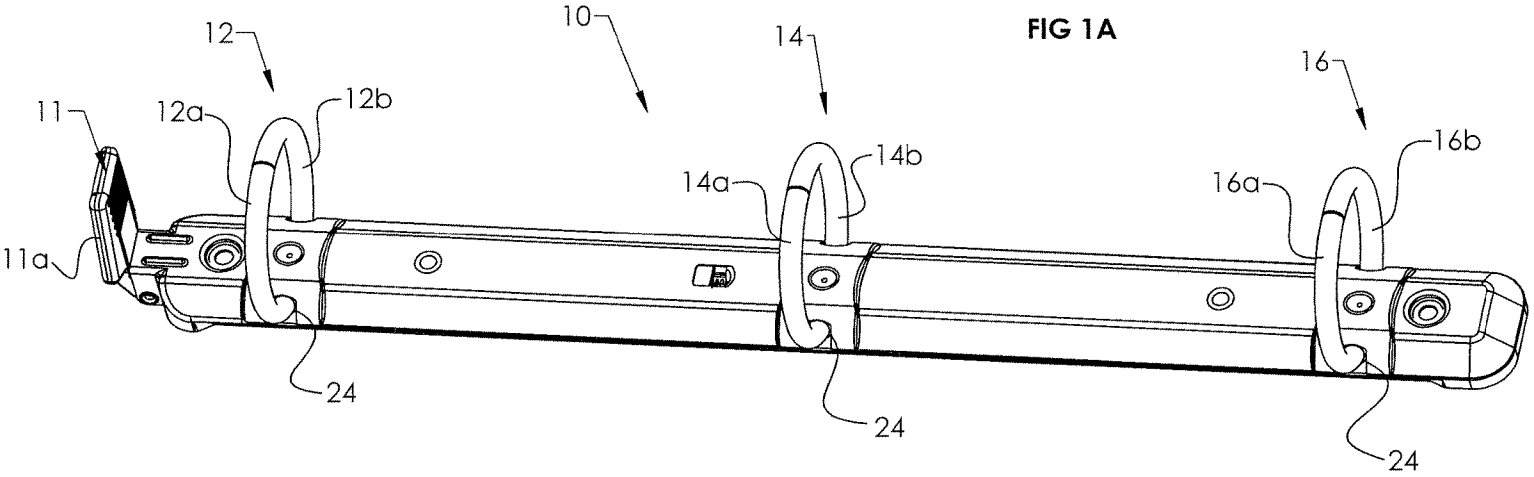
FIG. 1A is a perspective view of an improved locking ring metal of the present invention having a vertically extending trigger.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Figure 1B:
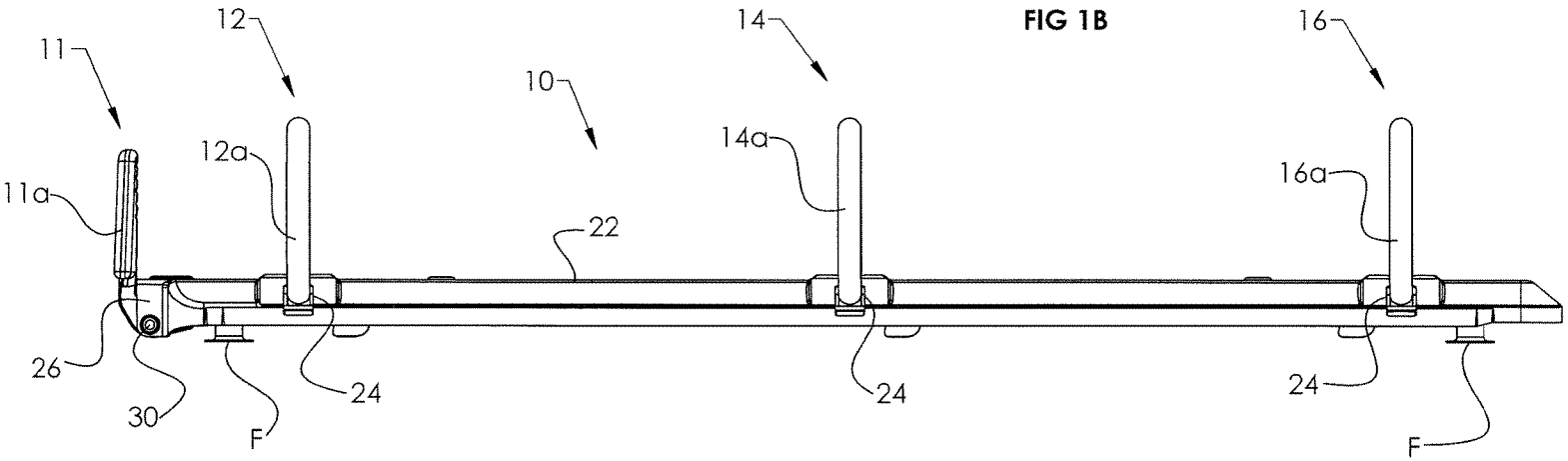
FIG. 1B is an elevation view thereof.
Figure 2A:
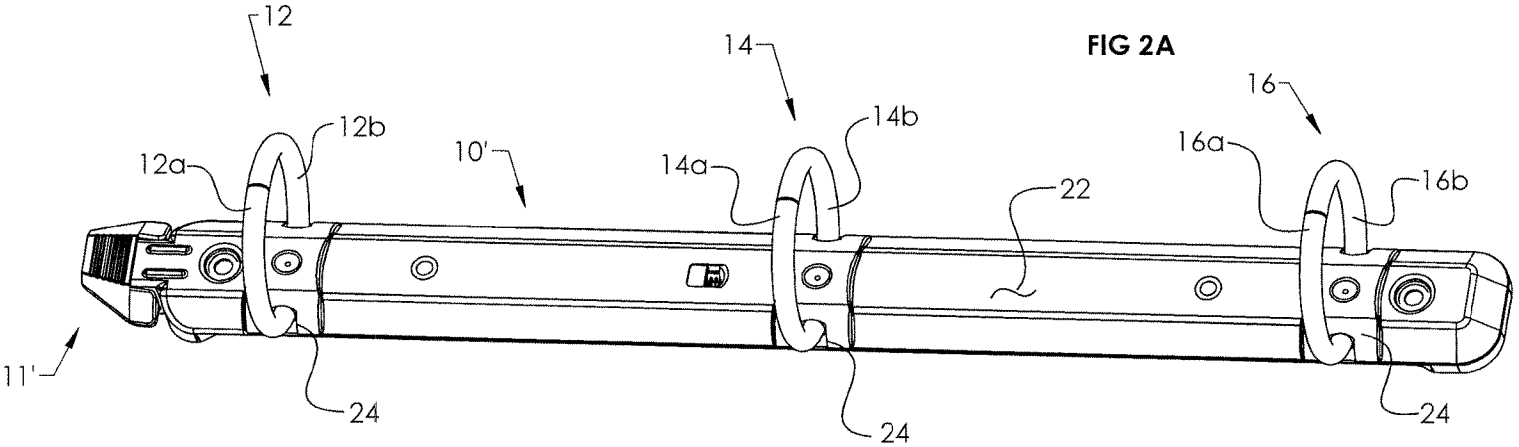
FIG. 2A is a perspective view of an improved locking ring metal of the present invention having a horizontally extending trigger.
Figure 2B:
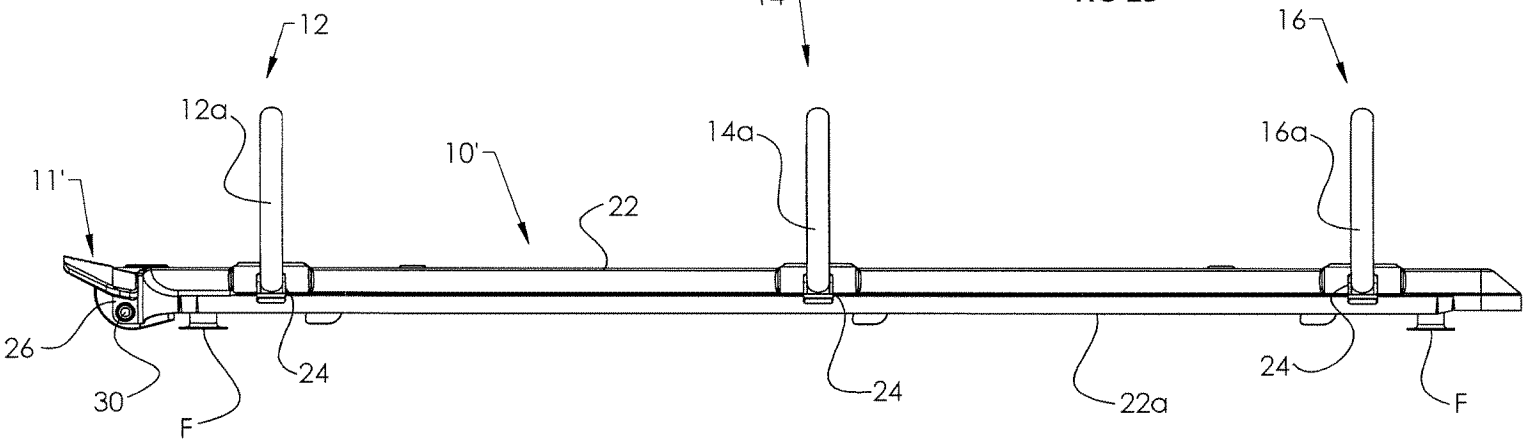
FIG. 2B is an elevation view thereof.
Figure 3:
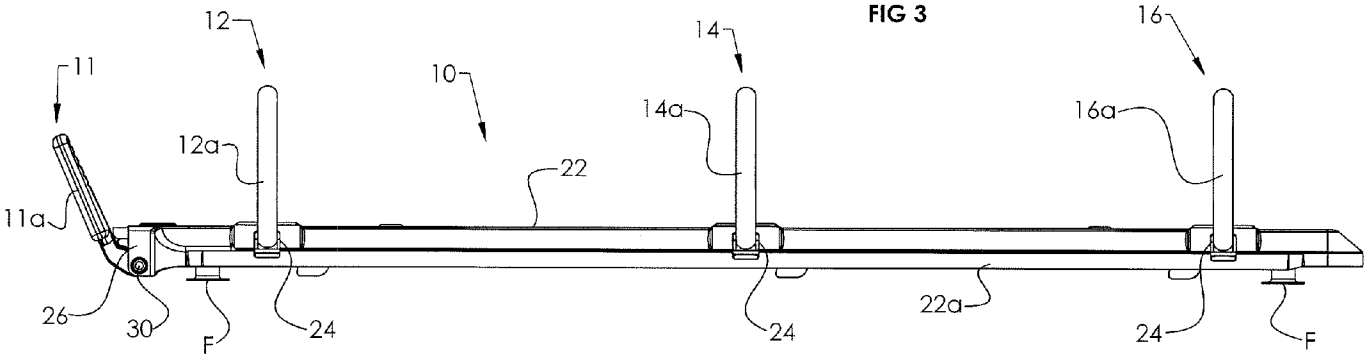
FIG. 3 is a view similar to FIG. 1B but in the ring metal open position.
Figure 8:
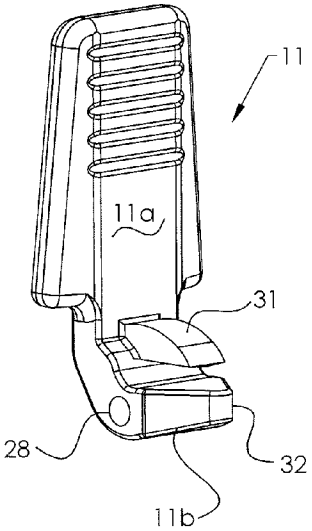
FIG. 8 is a perspective view of a vertically extending trigger installed in the ring metal.
Figure 6:
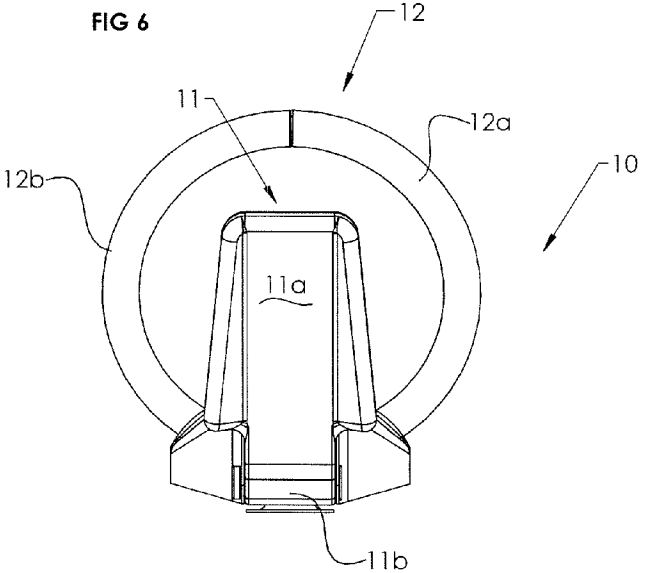
FIG. 6 is an end view of the ring metal in its closed position.
Figure 5:
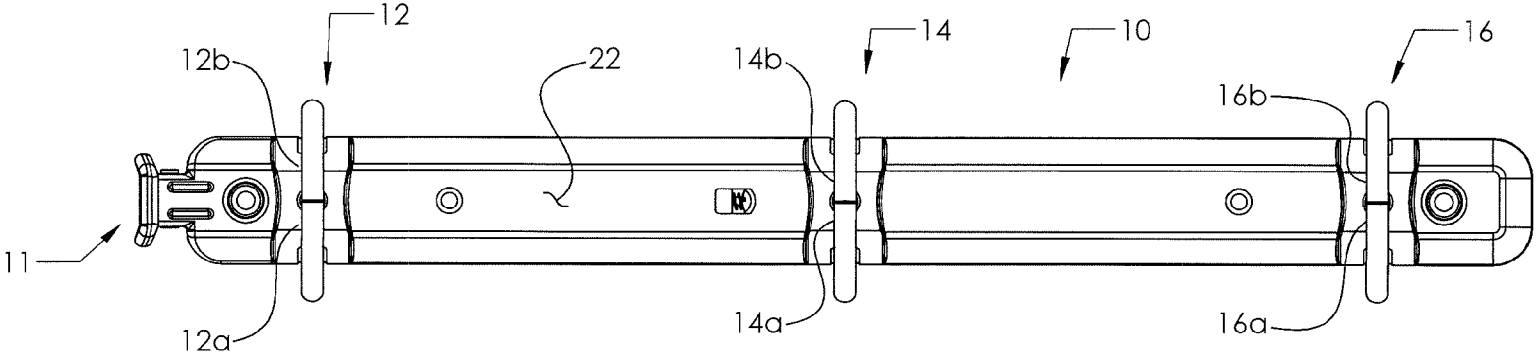
FIG. 5 is a top plan view of the ring metal in its closed position.
Figure 4:
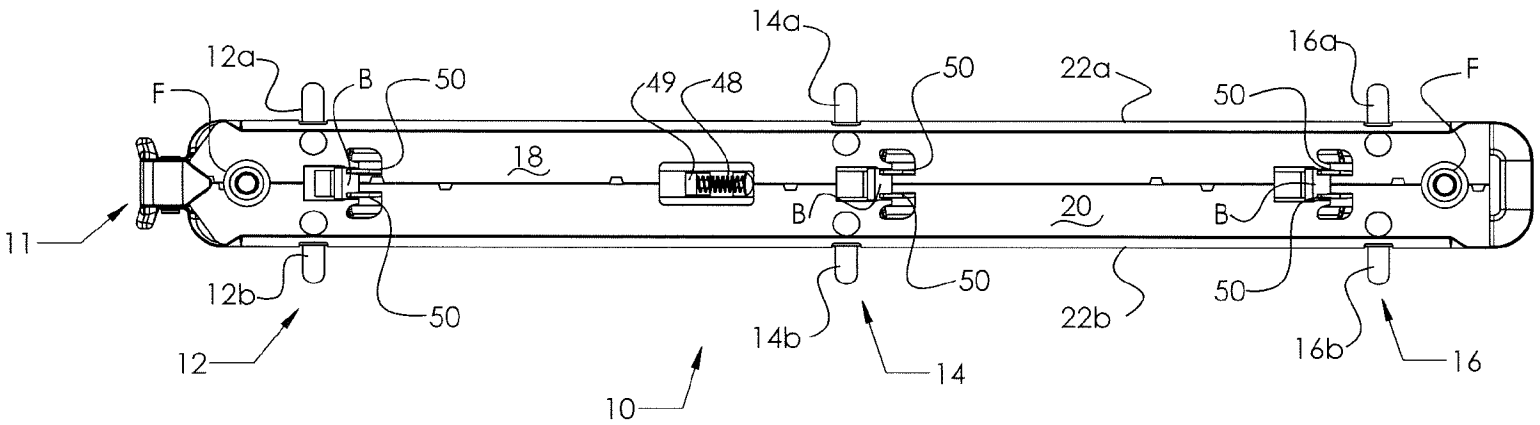
FIG. 4 is a bottom plan view of the ring metal in its closed position.
Figure 10:
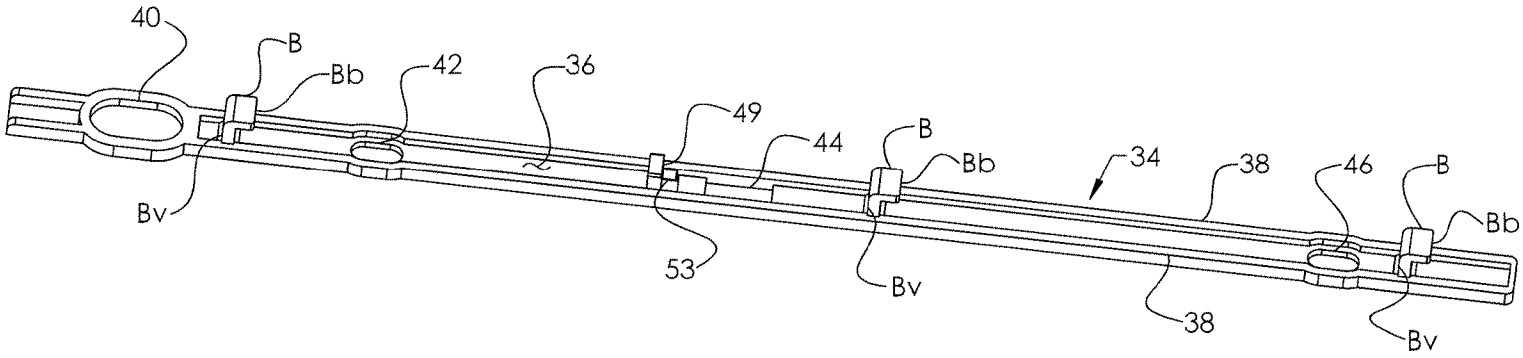
FIG. 10 is a perspective view of a travel bar installed in the ring metal.

Referring to the drawings, a locking ring metal of the present invention for use in a ring binder (not shown) holding hole-punched sheets of paper and the like is indicated generally 10 in FIGS. 1A and 1B, and 10' in FIGS. 2A and 2B. Ring metal 10 or 10' is attached to the spine portion of the binder in a conventional manner using fasteners F. Although referred to as a metal or ring metal hereafter, those skilled in the art will understand that metal 10 or 10' can be either of a metal or a plastic construction, or a combination of metal and plastic. The difference between metal 10 and metal 10' is that metal 10 has a vertically extending trigger 11 installed at one end of it; while metal 10' has a horizontally extending trigger 11' installed at that end. The description which follows will be directed at metal 10; although, those skilled in the art will appreciate that the construction and operation of the invention can also be implemented with metal 10'.

Ring metal 10 includes at least one, and preferably a plurality of binder rings. As shown in the drawings, ring metal 10 includes three spaced apart rings 12, 14, and 16 each of which is comprised of two complementary curved ring segments 12*a*, 12*b*, 14*a*, 14*b*, and 16*a*, 16*b* respectively. The rings 12 and 16 are located adjacent each end of the ring metal with ring 14 located approximately midway the length thereof. Each ring segment has one end attached to a hinge plate or frame 18, 20 respectively. The frames are each a generally rectangular shaped plate and the frames extend side-by-side, parallel to each other, substantially the length of ring metal 10. When binder rings 12, 14, 16 are opened, as described herein, frames 18, 20 are flexed. Movement of frames 18, 20 in this regard causes the outer, mating ends of the respective rings to separate from each other and open the binder. Those skilled in the art will understand that ring metal 10 could have more or fewer rings than the rings 12, 14, 16 without departing from the scope of the invention.

In one embodiment of the invention, a post 21P (see FIG. 15) is formed on the outer end of each ring half 12*a*, 14*a*, 16*a*, and a socket 21S (see FIG. 13) is formed in the outer end of the other ring half 12*b*, 14*b*, 16*b*. This type of ring construction is commonly referred to as "gap free" in that the even if the outer ends of a ring start to pull apart, the post 21P initially remains inserted in the socket 21S so a gap does not form between the ends of the ring. Gap free ring metal constructions are known in the art. See, for example, U.S. Pat. No. 4,690,580 (the '580 patent) and D451,954. Since the gap free construction of ring metal 10, 10' is made in accordance with the teachings of the '580 U.S. patent, it will be not be described.

Figure 7:
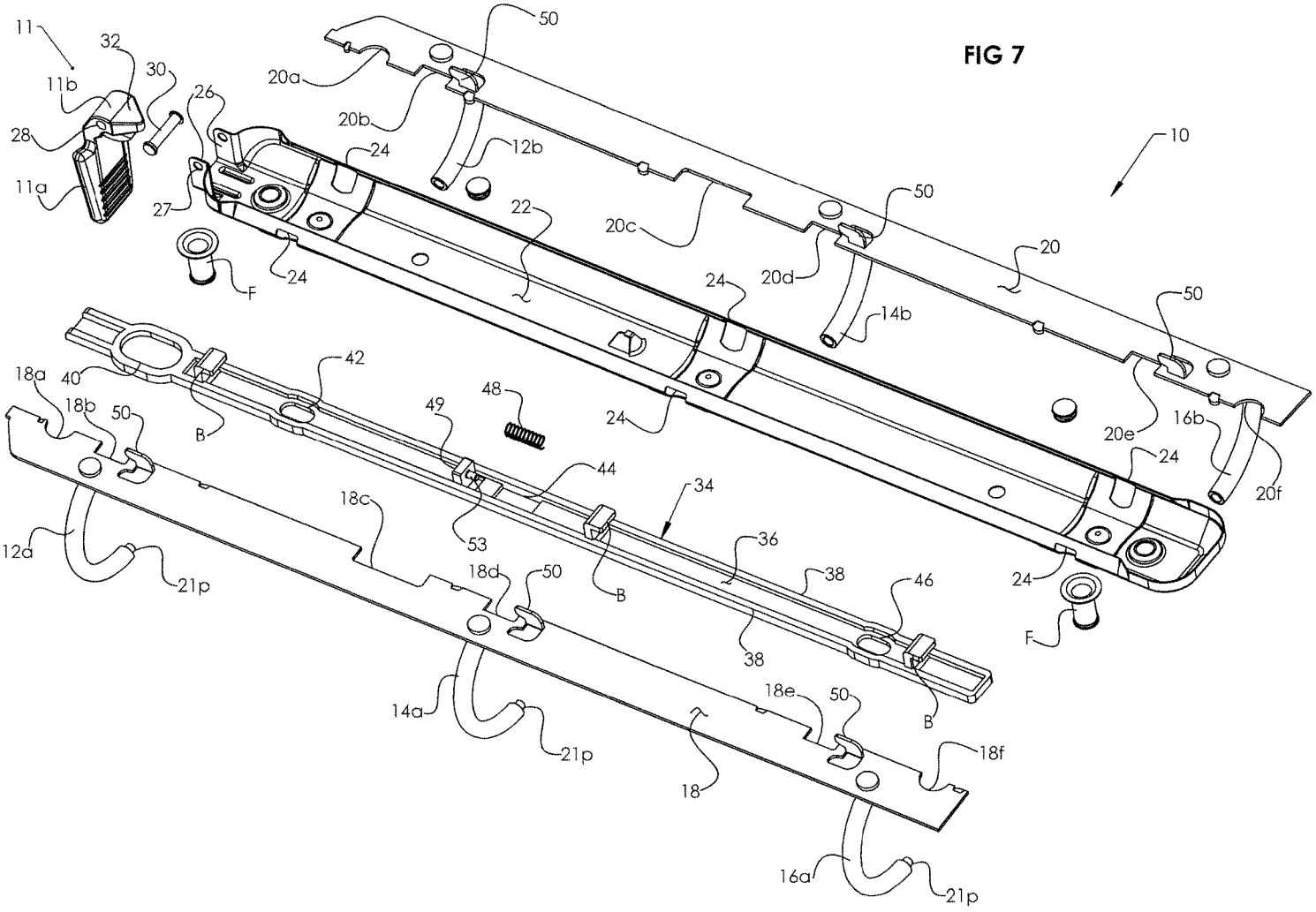
FIG. 7 is an exploded view of the ring metal.
Figure 12:
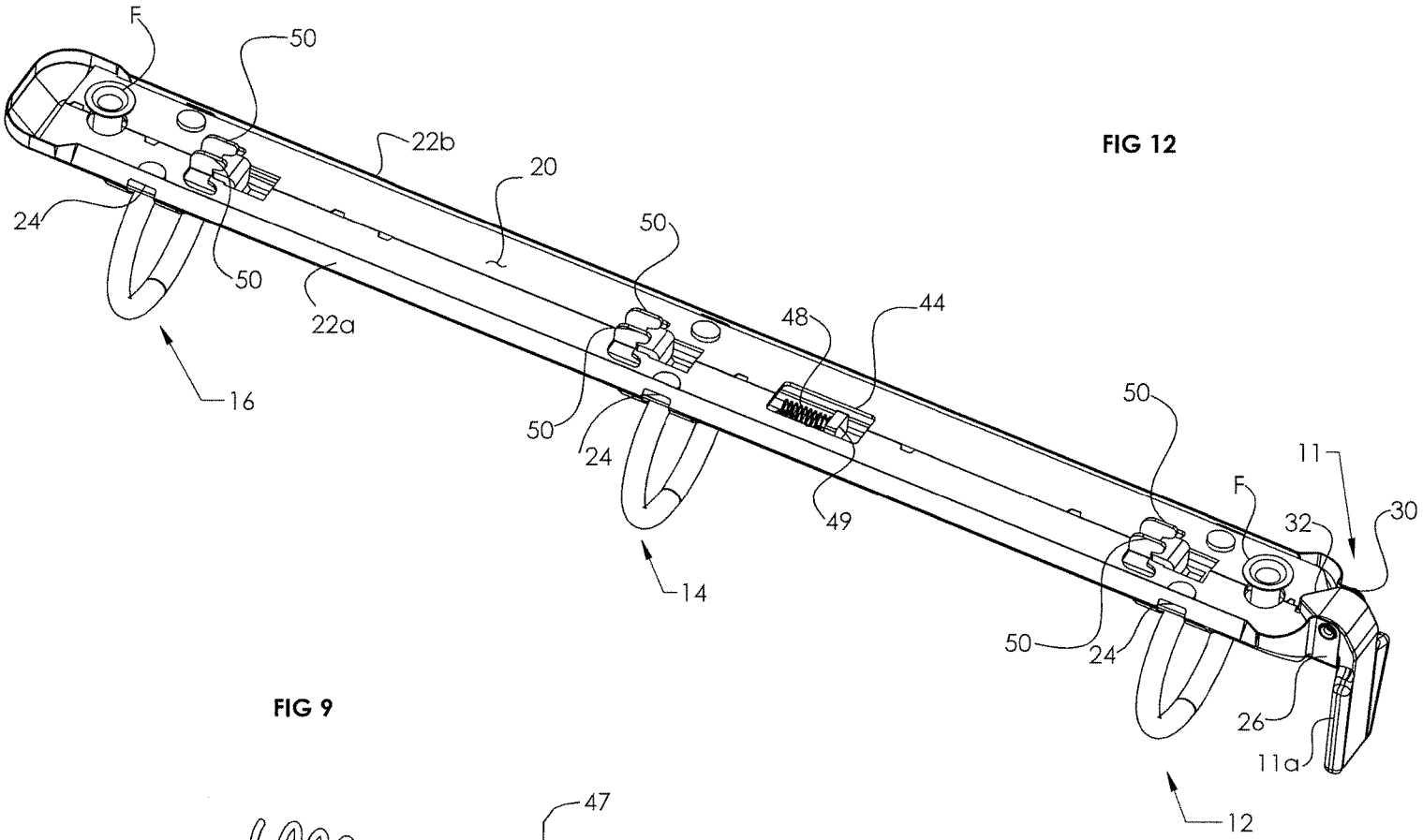
FIG. 12 is a perspective view of the underside of the ring metal.
Figure 9:
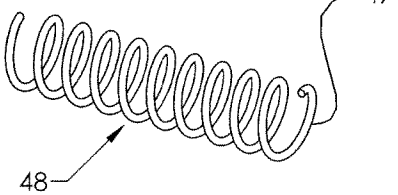
FIG. 9 is a perspective view of a coil spring installed in the ring metal.

Referring to FIG. 7, each of the frames has cutout sections 18*a*-18*e* and 20*a*-20*e* formed along their inner reach. The corresponding sections on each frame are identical in size and shape with those in the other frame. These cutout sections are to accommodate installation of the frames in the ring metal assembly as well as facilitate opening and closing of the binder rings as described hereinafter.

A cover, housing, or shield 22 extends the length of ring metal 10. Frames 18, 20 are installed within cover 22 and the cover has spaced openings 24 along each side through which the respective ring segments extend so to curve up and over the top of the housing. Shield 22 has a curved upper surface with flanks 22*a*, 22*b* that extend downwardly and inwardly from the sides of the shield. The outer edges of frames 18, 20 extend along the length of cover 20 between the upper, curved top surface of the housing and flanks 22*a*, 22*b* of the housing. Posts F located at each end of the cover extend from the underside of the cover and are used for fastening ring metal 10 to the binder spine using rivets or the like, all as is well-known in the art.

Trigger mechanism 11, as previously noted, is located at one end of ring metal 10 and is rotatably secured to the ring metal housing. Referring to FIG. 7, respective brackets 26 extend downwardly from each side of cover 22 at the one end of the housing where trigger 11 is mounted to the housing. Each bracket has an opening 27 in its lower end. Trigger 11 has a generally vertical or finger pad section 11*a* and a lower, horizontal section 11*b*. A bore 28 extends through section 11*b* and a pin 30 is inserted through this bore and the openings 27 in the respective brackets 26 to attach trigger 11 to the brackets and install the trigger to cover 22. In operation, pushing against finger pad section 11*a* of trigger 11 causes the trigger to rotate or pivot about pin 30.

Figure 13:
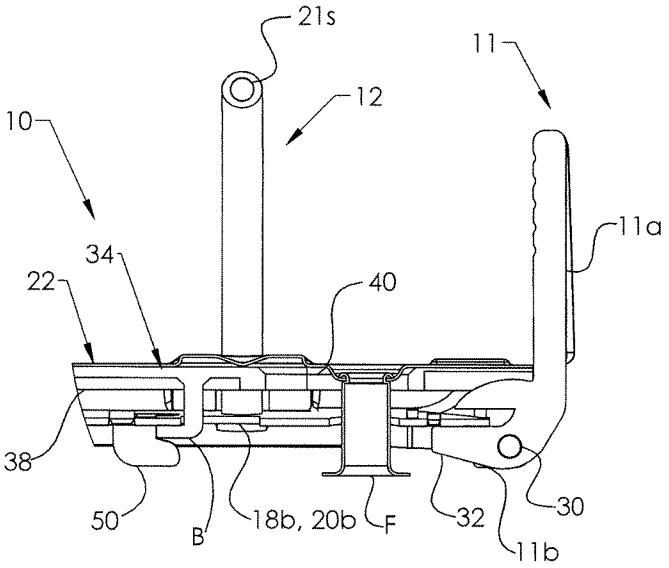
FIG. 13 is a partial view of one end of the ring metal with one of the frames removed so to illustrate the position of the trigger and travel bar when the ring metal is closed.

Trigger section 11*b* includes an upper horizontally extending projection 31, and a lower horizontally extending projection or tongue 32. When trigger 11 is mounted to housing 22, the ends of the frames 18, 20 at the one end of ring metal 10, are set between projection 31 and tongue 32. This is as shown in FIG. 13.

Figure 15:
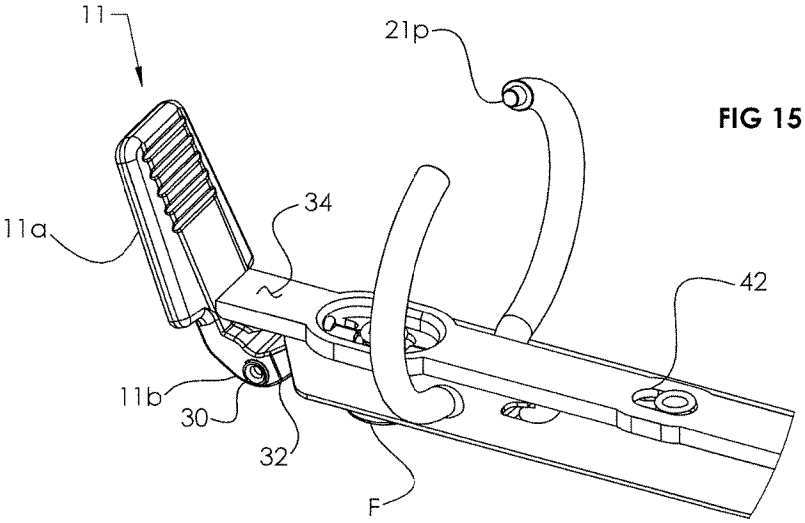
FIG. 15 is an enlarged view of one end of the ring metal illustrating the position of the trigger and travel bar when the ring metal is open.

A travel bar indicated generally 34 in the drawings is installed in ring metal 10. Importantly, travel bar 34 is not connected to trigger 11, but rather overlays the frames 18, 20 with its end adjacent the trigger spatially separated from the trigger as shown in FIG. 13. The travel bar, which extends substantially the length of housing 22, is installed within the housing beneath the top surface of the cover, and above frames 18, 20 so to overlay the frames. As described herein, when ring metal 10 is opened, travel bar 34 moves toward trigger 11 even though the travel bar is not connected to the trigger. When ring metal 10 is fully opened, the end of travel bar 34 adjacent trigger 11 overlays projection 31 of the trigger as shown in FIG. 15.

Figure 11:
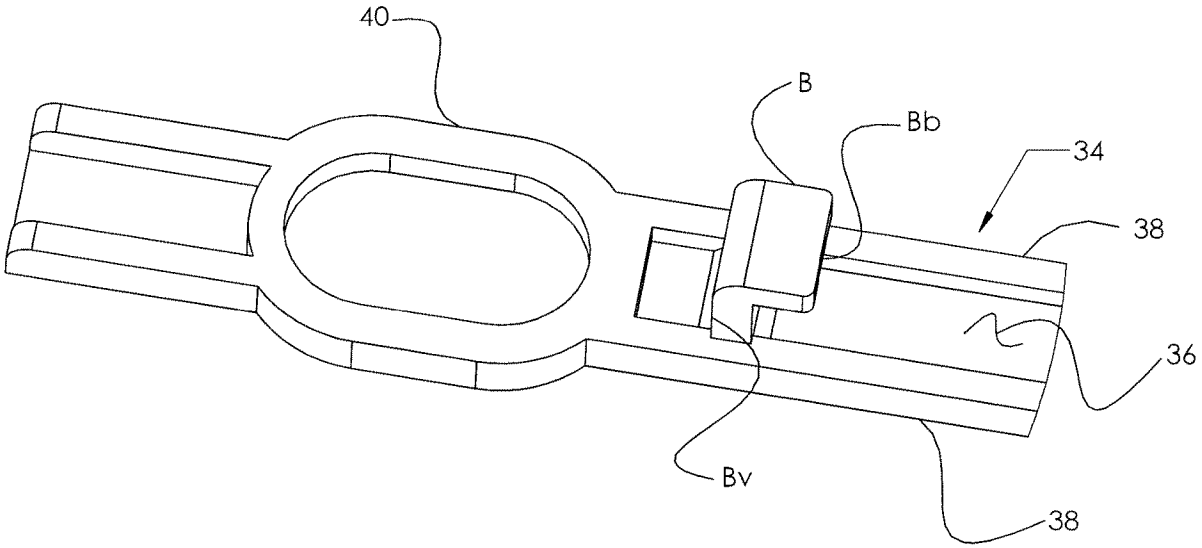
FIG. 11 is an enlarged view of one end of the travel bar.

Referring to FIGS. 7, 10, and 11, travel bar 34 has a top 36 and side rails 38 extending beneath the top of the travel bar along each side thereof and extending the length of the travel bar. The width of travel bar 34 is greater than that of projection 31 of trigger 11. The ends of the side rails adjacent trigger 11 are rounded as shown in FIGS. 10 and 11. Inwardly from this end of travel bar 34, the travel bar as an oval shaped segment 40 which is open in its center. As shown in FIG. 13, this allows travel bar 34 to move longitudinally of ring metal 10 about the upper end of the fastener F located at this end of the assembly. The travel bar has additional oval shaped openings 42 and 46 formed at spaced intervals along its length to accommodate movement of the travel bar back and forth underneath housing 22, about the fastener F at the other end of the assembly, and protrusions on the underside of the top portion of the cover. The travel bar also has a rectangular shaped opening 44 formed approximately midway along its length for one end 47 of a coil spring 48, which is mounted on travel bar 34, to extend through top surface 36 of the travel bar and seat against a bracket 49 (see FIG. 14) formed on the underside of the top of cover 22. When spring 48 is mounted as shown in FIG. 14, it biases travel bar 34 to move in the binder ring opening direction.

Figure 16:
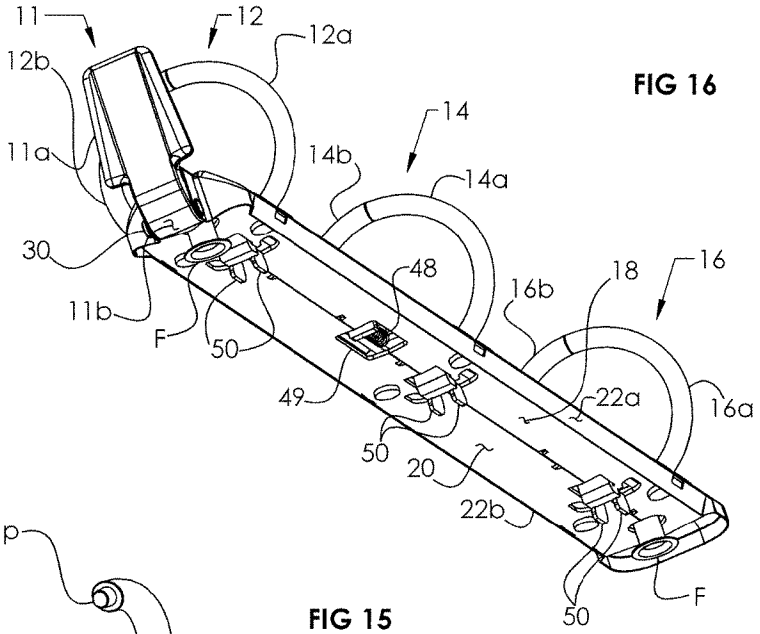
FIG. 16 is a perspective view of the underside of the ring metal when the ring metal is closed; and, FIG. 17 is a perspective view of the underside of the ring metal when the ring metal is open.

At least one, and preferably a plurality of spaced blocking elements B are formed on the underside of travel bar 34. Three blocking elements B are shown in the drawings. Each blocking element has an L shape including a base Bb which extends parallel to the travel bar and a vertical section By (see FIGS. 10 and 11) extending from the underside of the travel bar. The respective blocking elements B extend through the corresponding openings 18*b*, 20*b*, 18*d*, 20*d*, and 18*e*, 20*e* formed in frames 18, 20. These locations correspond to the locations of the rings 12, 14, and 16 when metal 10 is closed. As shown in FIG. 16, when ring metal 10 is closed, the lower, base end of each blocking element B extends through these openings in frames 18, 20.

In addition to blocking elements B, a vertical plate 49 depends from the underside of the travel bar. Plate 49 is located midway along the length of travel bar 34, but spaced from opening 44 in the travel bar as shown in FIG. 10. A post 53 extends from the inner face of plate 49 which comprises the bracket for seating end 47 of coil spring 48. The other end of coil spring 48 attaches to an L-shaped tab 51 formed on the underside of cover 22 (see FIG. 13) so to impart a bias force on the travel bar. Again, this bias force is in the direction to open, not close, ring metal 10 and the binder rings.

Figure 14:
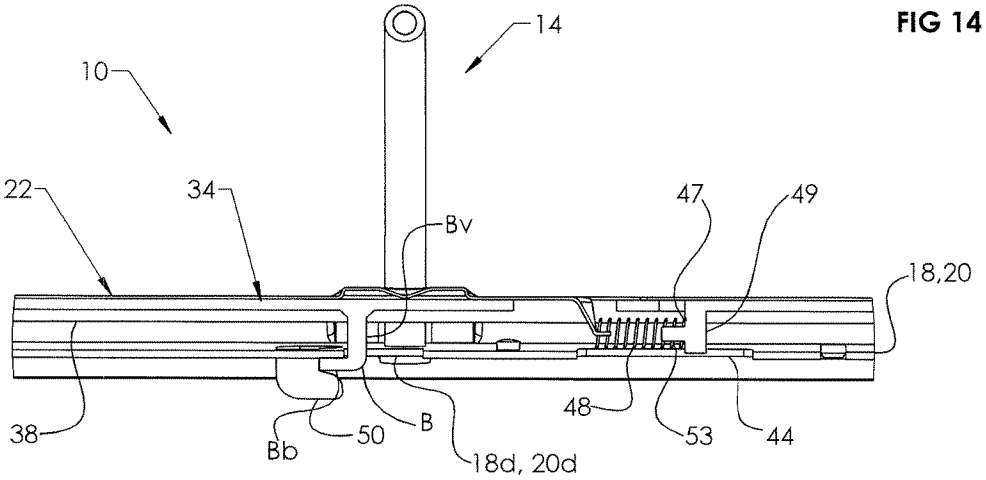
FIG. 14 is a view of an intermediate portion of the ring metal with one of the frames removed to further illustrate the position of the travel bar when the ring metal is closed.

Referring to FIGS. 13, 14, on the underside of each frame 18, 20 adjacent cutout sections 18*b*, 18*d*, 18*e* of frame 18, and the corresponding cutout sections 20*b*, 20*d*, 20*e* of frame 20, identical inverted L-shaped shaped brackets 50 are formed. As shown in the drawings, each bracket 50 comprises identically formed segments on the underside of each frame 18, 20. The height of each bracket 50 is such that when ring metal 10 is closed, base Bb of the respective blocking elements B on travel bar 34 seats in one of the brackets. In this position, they are located on the underside of frames 18, 20 and prevent any rotary movement of the frames. Accordingly, blocking elements B and brackets 50 comprise a co-operating means for effectively locking ring metal 10 in its closed position.

Figure 17:
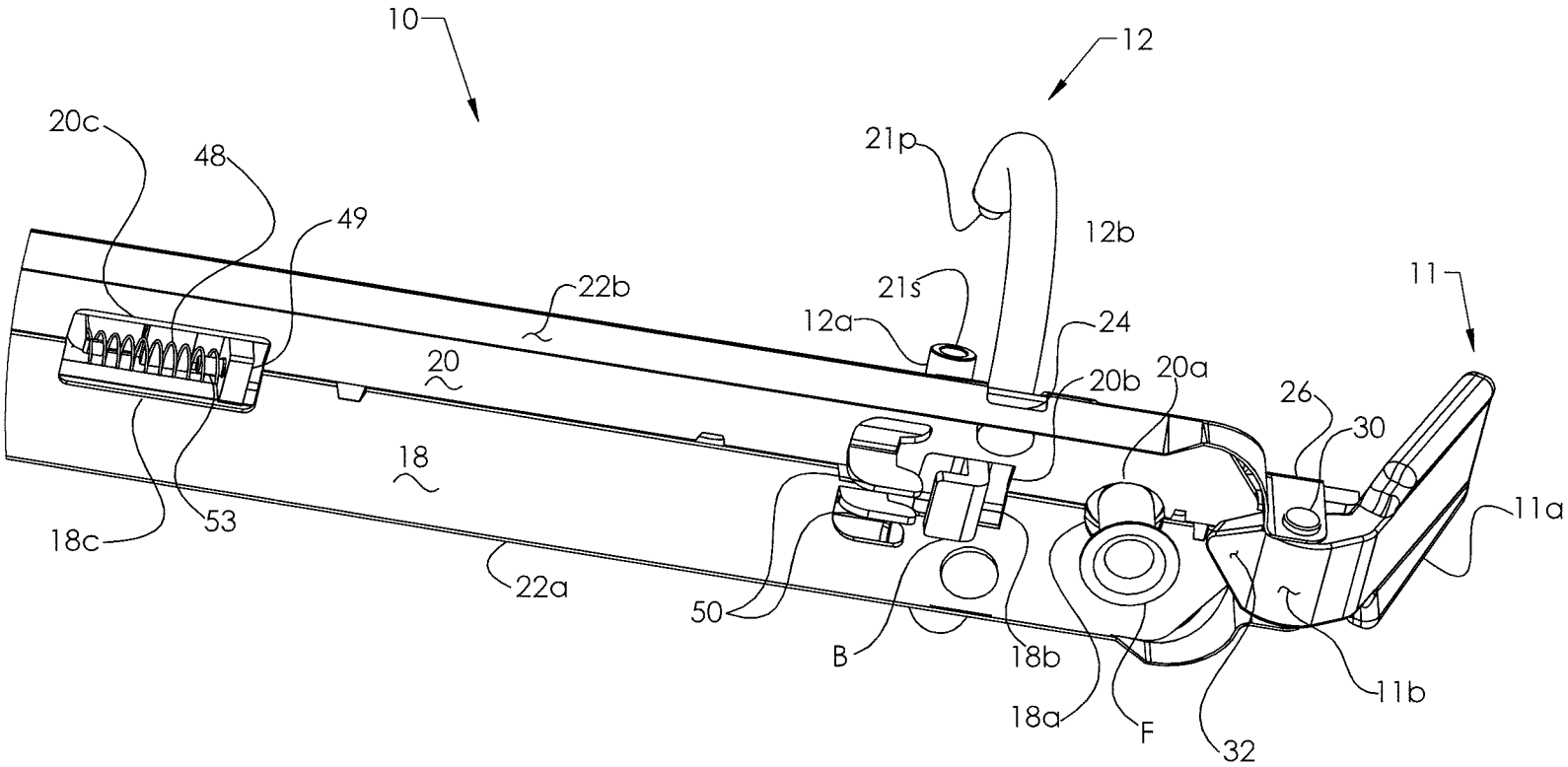

Now, as travel bar 34 moves toward trigger 11, when the trigger is pressed in the direction to open metal 10, the blocking elements B move with the travel bar. As the travel bar continues to move, two things happen. First, base Bb of each blocking element is drawn away from its associated bracket 50. Second, as part of this movement, the blocking elements are drawn into the cutout sections 18*b*, 18*d*, 18*e* of frame 18, and the corresponding cutout sections 20*b*, 20*d*, 20*e* of frame 20. When the base Bb of each blocking element B is completely withdrawn from its associated bracket 50, they are also fully moved into the cutout sections of frames 18, 20. I.e., the blocking elements are no longer positioned under the frames. This is shown in FIG. 17. This movement of travel bar 34 in the binder ring opening direction, under the force of spring 48, now allows frames 18, 20 to freely move (i.e., rotate) in the binder ring opening direction. At the same time this is occurring, tongue 32 of trigger 11 contacts the underside of frames 18, 20 pushing them upwards.

When the binder rings of ring metal 10 are to be closed, a user pushes trigger section 11*a* in the opposite direction. In doing so, projection 31 of the trigger now presses down against the upper surfaces of frames 18, 20 mechanically forcing (rotating) them in a downward direction. This action also mechanically forces travel bar 34 to move in the direction away from trigger 11, this movement being against the opening force provided by spring 48. Continued movement of the travel bar moves the base Bb of each blocking element back toward its original position in which the bases are again inserted into the space between the base of brackets 50 and the underside of frames 18, 20. This results in locking the frames in their binder ring closed position.

Alternately, the user can press the separated sections of one of the rings 12, 14, 16 back together. This movement pivots frames 18, 20 back toward their original position. In doing so, the underside of the frames push downwardly against tongue 32 of trigger 11 forcing the trigger back toward its original metal ring 10 closed position. This action further forces travel bar 34 to move in the direction away from trigger 11 to close the ring metal; which force is against the opening force provided by spring 48. Continued movement of the travel bar moves the base portion of blocking elements B back toward their original positions in which they are again inserted into the space between the base of brackets 50 and the underside of frames 18, 20, locking the frames in the binder ring closed position.

In view of the above, it will be seen that the several objects and advantages of the present disclosure have been achieved and other advantageous results have been obtained.

Having thus described the invention, what is claimed and desired to be secured by Letters Patent is:

1. A locking ring metal for a loose leaf binder comprising:

at least one binder ring formed by a pair of complementary shaped binder ring halves;

a pair of frames, one end of each ring half being attached to a respective one of the frames, the frames being movable relative to each other to move the other ends of the ring halves out of and into contact with each other so as to open and close the at least one binder ring;

a bracket formed on an underside of the frames;

a housing in which the frames are installed;

a trigger mounted on one end of the housing for moving the frames to open and close the binder ring;

a travel bar positioned within the housing above the frames, the travel bar contacting the trigger but not connected to the trigger or any other element intermediate the travel bar and the trigger and with no portion of the travel bar being received into any portion of the trigger, the travel bar adapted to move between a first position in which the at least one binder ring is opened and a second position in which the at least one binder ring is closed, the travel bar including a blocking element configured to fit into the bracket when the binder ring is closed and, when in its closed position, prevents movement of the frames in a direction to open the at least one binder ring so as to lock the at least one binder ring in its closed position; and, a compression spring directly attached to the travel bar, said spring adapted to bias the travel bar only to said first position that allows the frames to move relative to each other so as to open the at least one binder ring for said spring to bias the travel bar to open the ring metal.

2. The locking ring metal of claim 1 in which movement of the trigger to open the binder ring brings the trigger into contact with the travel bar with continued movement of the trigger to open the binder ring moving the travel bar to a position in which the blocking element is withdrawn from the bracket and no longer prevents movement of the frames, for the frames to then move in the direction to open the at least one binder ring.

3. The locking ring metal of claim 2 in which the frames extend longitudinally of the housing in a side-by-side arrangement and, when the ring metal is closed, the blocking element fits into the bracket to prevent movement of the frames in a direction to open the at least one binder ring.

4. The locking ring metal of claim 3 in which corresponding sections of an opening are formed in each frame with the blocking element spaced from the opening when the at least one binder ring is closed, movement of the travel bar by the trigger to open the at least one binder ring withdrawing the blocking element from the bracket and into the opening thereby allowing the frames to move to open the at least one binder ring.

5. The locking ring metal of claim 1 including a plurality of spaced binder rings each formed by complementary binder ring halves one end of each of which is attached to one of the frames for movement of a lever to effect opening of all the binder rings.

6. The locking ring metal of claim 5 in which an outer end of one of the ring halves of each binder ring has a post formed on it and the outer end of the other ring half has a socket formed in it in which the post fits when the binder ring is closed, thereby to form a gap free binder ring construction.

7. The locking ring metal of claim 6 in which the travel bar has a plurality of blocking elements located along a length of the travel bar and fitting into a corresponding bracket formed on an underside of the frames so as to prevent movement of the frames when the binder rings are closed.

8. The locking ring metal of claim 7 in which the blocking elements are located adjacent a location of the respective binder rings when the binder rings are closed.

9. The locking ring metal of claim 8 in which corresponding sections of openings are formed in each frame with each blocking element spaced from one end of one of the openings when the binder ring is closed, movement of the travel bar by the trigger to open the binder rings withdrawing each blocking element from its corresponding bracket and into a corresponding opening so as to allow the frames to move to open the binder rings.

10. The locking ring metal of claim 9 in which each blocking element and its corresponding bracket are L-shaped.

11. The locking ring metal of claim 4 in which the trigger includes a projection which extends over one end of the frames and a tongue which extends beneath said end of the frames, the tongue bearing against an underside of the frames, at one end thereof, to facilitate opening the at least one binder ring, and the projection bearing against a top of the frames to facilitate closing the at least one binder ring.

12. A locking ring metal for a loose leaf binder comprising:

a plurality of binder rings spaced along a length of the ring metal, each ring being formed by a pair of complementary shaped binder ring halves;

a pair of frames, one end of each ring half being attached to a respective one of the frames, the frames being movable relative to each other to move the other ends of the ring halves out of and into contact with each other so as to open and close the binder rings;

a housing in which the frames are installed;

a trigger mounted on one end of the housing for moving the frames to open and close the binder rings;

a travel bar positioned within the housing above the frames, the travel bar contacting the trigger but not connected to the trigger or any other element intermediate the travel bar and the trigger and with no portion of the travel bar being received into any portion of the trigger, the travel bar adapted to move between a first position in which the binder rings are opened and a second position in which the binder rings are closed;

co-operating means formed on the travel bar and the frames and configured to prevent movement of the frames, when the binder rings are closed, to open the binder rings; and, a compression spring one end of which is directly attached to the travel bar and the other end of which is attached to the housing, said spring adapted to bias the travel bar only to said first position that allows the frames to move relative to each other so as to open the binder rings for said spring to bias the travel bar to open the ring metal.

13. The locking ring metal of claim 12 in which the co-operating means includes brackets formed on an underside of the frames at a location of each binder ring, and the travel bar includes a plurality of blocking elements each of which fits into a respective one of the brackets when the binder rings are closed.

14. The locking ring metal of claim 12 in which an outer end of one of the ring halves of each binder ring has a post formed on it and the outer end of the other ring half has a socket formed in it in which the post fits when the binder ring is closed, thereby to form a gap free binder ring construction.

15. The locking ring metal of claim 13 in which corresponding openings are formed in each frame with each blocking element spaced from one end of one of the openings when the binder ring is closed, movement of the travel bar by the trigger to open the binder rings withdrawing each blocking element from its corresponding bracket and into its corresponding opening so as to allow the frames to move to open the binder rings.

16. The locking ring metal of claim 15 in which the trigger includes a projection extending over one end of the frames when the ring metal is closed and a tongue which extends beneath said end of the frames, movement of the trigger when the ring metal is to be opened bringing the tongue into contact with an underside of the frames for continued movement of the trigger to move the frames in a direction to open the binder rings; and, when the ring metal is to be closed, movement of the trigger bringing the projection into contact with an upper surface of the frames for continued movement of the trigger to move the frames in an opposite direction to close the binder rings.

17. A locking ring metal for a loose leaf binder comprising:

a plurality of binder rings spaced along a length of the ring metal, each ring being formed by a pair of complementary shaped binder ring halves;

a pair of frames, one end of each ring half being attached to a respective one of the frames, the frames being movable relative to each other to move the other ends of the ring halves out of and into contact with each other so as to open and close the binder rings;

a housing in which the frames are installed;

a trigger mounted on one end of the housing for moving the frames to open and close the binder rings;

a travel bar positioned within the housing above the frames, the travel bar contacting the trigger but not connected to the trigger or any other element intermediate the travel bar and the trigger and with no portion of the travel bar being received into any portion of the trigger, the travel bar adapted to move between a first position in which the binder rings are opened and a second position in which the binder rings are closed;

co-operating means formed on the travel bar and the frames and configured to prevent movement of the frames, when the binder rings are closed, to open the binder rings;

a compression spring one end of which is directly attached to the travel bar and the other end of which is attached to the housing, said spring adapted to bias the travel bar only to said first position that allows the frames to move relative to each other so as to open the binder rings for said spring to bias the travel bar to open the ring metal; and, an outer end of one of the ring halves of each binder ring having a post formed on it and the outer end of the other ring half having a socket formed in it in which the post fits when the binder ring is closed, thereby to form a gap free binder ring construction.

18. The locking ring metal of claim 17 in which the co-operating means includes a bracket formed on an underside of the frames at a location of each binder ring, and the travel bar includes a plurality of blocking elements each of which fits into a corresponding bracket when the binder rings are closed.

19. The locking ring metal of claim 18 in which corresponding openings are formed in each frame with each blocking element spaced from one end of one of the openings when the binder rings are closed, movement of the travel bar by the trigger to open the binder rings withdrawing each blocking element from its corresponding bracket and into its corresponding opening so as to allow the frames to move to open the binder rings.

20. The locking ring metal of claim 19 in which the trigger includes a projection extending over one end of the frames when the ring metal is closed and a tongue which extends beneath said end of the frames, movement of the trigger when the ring metal is to be opened bringing the tongue into contact with an underside of the frames for continued movement of the trigger to move the frames in a direction to open the binder rings; and, when the ring metal is to be closed, movement of the trigger bringing the projection into contact with an upper surface of the frames for continued movement of the trigger to move the frames in an opposite direction to close the binder rings.

* * * * *